United States Patent [19]

Brown

[11] 4,412,485

[45] Nov. 1, 1983

[54] PRESS FOR EXPRESSING LIQUID FROM A MASS

[75] Inventor: Douglas B. Brown, Ottawa, Canada

[73] Assignee: Stake Technology Limited, Ottawa, Canada

[21] Appl. No.: 243,699

[22] Filed: Mar. 16, 1981

[30] Foreign Application Priority Data

Mar. 27, 1980 [CA] Canada ..... 348560

[51] Int. Cl.[3] ..... B30B 9/12

[52] U.S. Cl. ..... 100/117; 100/127; 100/137; 100/148

[58] Field of Search ..... 100/37, 43, 117, 104, 100/110, 126, 127, 147, 148, 137, 138, 904, 35, 41; 425/204, 207, 376 R

[56] References Cited

U.S. PATENT DOCUMENTS

| | | | |
|---|---|---|---|
| 837,010 | 11/1906 | Vernsten | 100/148 |
| 2,810,339 | 10/1957 | Satzinger | 100/117 X |
| 3,054,343 | 9/1962 | Pellett | 100/148 |
| 3,394,649 | 7/1968 | Kemper | 100/117 X |
| 3,590,730 | 7/1971 | Heinrich | 100/117 |
| 3,715,977 | 2/1973 | Mackenzie | 100/117 |
| 4,117,776 | 10/1978 | Hunt | 100/117 |
| 4,119,025 | 10/1978 | Brown | 100/148 X |

FOREIGN PATENT DOCUMENTS

| | | | |
|---|---|---|---|
| 576090 | 10/1977 | U.S.S.R. | 100/117 |

*Primary Examiner*—Billy J. Wilhite

*Attorney, Agent, or Firm*—Stevens, Davis, Miller & Mosher

[57] ABSTRACT

A press for continuous expressing of a liquid from a particulate liquid/solid mass of the type including a conveyor screw or auger advancing the mass through a tubular housing which is provided with drainage perforations. The compression and advancement of the material through the perforate section is effected by the face of a reciprocating annular sleeve, the stroke of the sleeve being so arranged that at least one-half of the travel of said face takes place within the perforated area. The frequency of the reciprocating movement of the sleeve is three cycles per second or more, to reduce resistance to the passage of the mass through the housing. The device is capable of a considerable increase in dewatering performance, as compared with known devices of the type operating more or less solely with a conveyor screw.

4 Claims, 4 Drawing Figures

PRESS FOR EXPRESSING LIQUID FROM A MASS

The present invention relates to a press for expressing liquid out of a mass comprised of a particulate solid material portion and a liquid material portion.

In particular, the present invention relates to the field of dewatering presses of the type normally equipped with an auger which is designed to compress the processed mass, for instance lignocellulose material and water, and having a portion of a cylindric conduit coaxial with the auger perforated for discharge of the liquid expressed from the mass.

The above type of screw press apparatus has long been known in the art and different embodiments have successfully been introduced in the market. Reference may be had, for instance, to U.S. Pat. No. 4,117,776 (Hunt); U.S. Pat. No. 3,590,730 (Heinrich); U.S. Pat. No. 3,715,977 (MacKenzie); U.S. Pat. No. 2,810,339 (Satzinger) and other prior art references.

The field of application of machines of this kind is very broad. It may relate to juice extraction in food processing, but also to dewatering coal, reducing the moisture of sawdust, processing wood chips in pulp and paper making, dewatering pulp or the like.

One of the advantages of the above kind of dewatering machines is that they are capable of a continuous operation.

On the other hand, the presently known devices also suffer from disadvantages. In particular, it is often necessary to further dry the material processed by the press in order to further reduce the moisture contents thereof. This is due to the fact that the liquid removal or dewatering efficiency of the known presses is relatively limited. Furthermore, it is relatively difficult in known machines to adjustably control the degree at which the liquid is removed from the processed mass.

It is a primary object of the present invention to provide a device that would considerably increase the efficiency in liquid removal from the processed mass, by an apparatus that is relatively compact and yet provides high efficiency. Another object of the present invention is to provide an apparatus of the above type which is capable of selective adjustments of the degree of dewatering or liquid removal, in accordance with the particular application of the machine.

In general terms, the present invention provides a press for expressing liquid out of a mass comprised of a particulate solid material portion and a liquid material portion, said press being of the type having feeding means for feeding the mass through an inlet portion of the press; compression means for compressing said mass along a predetermined path within a housing means while advancing said mass to a discharge end thereof; and liquid passage means comprised in a portion of a wall of said housing for removal of a part of the liquid portion to thus reduce liquid content in said mass, wherein: said housing means is a hollow, tubular housing whose one axial end is generally coincident with said inlet portion, the other axial end of said housing being generally coincident with the said discharge end; said compression means is of the type including a conveyor screw combined with a reciprocating annular sleeve, said conveyor screw being coaxial with said housing, a portion of said conveyor screw being rotatably disposed inside said annular sleeve whose outside diameter generally corresponds to the inside diameter of said housing; said annular sleeve is slidable within said hollow housing and is operatively associated with first drive means for imparting to said sleeve a reciprocating motion relative to said housing and to said conveyor screw, in a direction generally coaxial with said housing and having a predetermined length of stroke; said annular sleeve has a free end face portion of a generally flat, annular configuration, facing said discharge end; said liquid passage means is a plurality of closely spaced passage openings extending generally radially through a portion of the wall of said housing to thus form a perforate section of said wall, said perforate section having an inside axial end relatively remote from said discharge end and an outside axial end relatively close to the discharge end; said annular sleeve and said liquid passage means being so arranged that said free end face portion thereof is disposed between said inside axial end and said outside axial end of the perforate section when the free end face portion of the sleeve is at the end of the stroke directed toward said discharge end.

Preferably, the frequency of the strokes of the sleeve is in excess of three cycles per second. It is further preferred that the path over which the face of the sleeve travels during the reciprocating motion be partly outside of the perforated region of the housing and partly inside thereof such that approximately 50% of the entire length of the stroke is disposed inside the perforated region.

Further features and advantages of the present invention will become apparent from the following detailed description of an embodiment of the present invention, with reference to the accompanying drawings. In the drawings.

Figure 1:
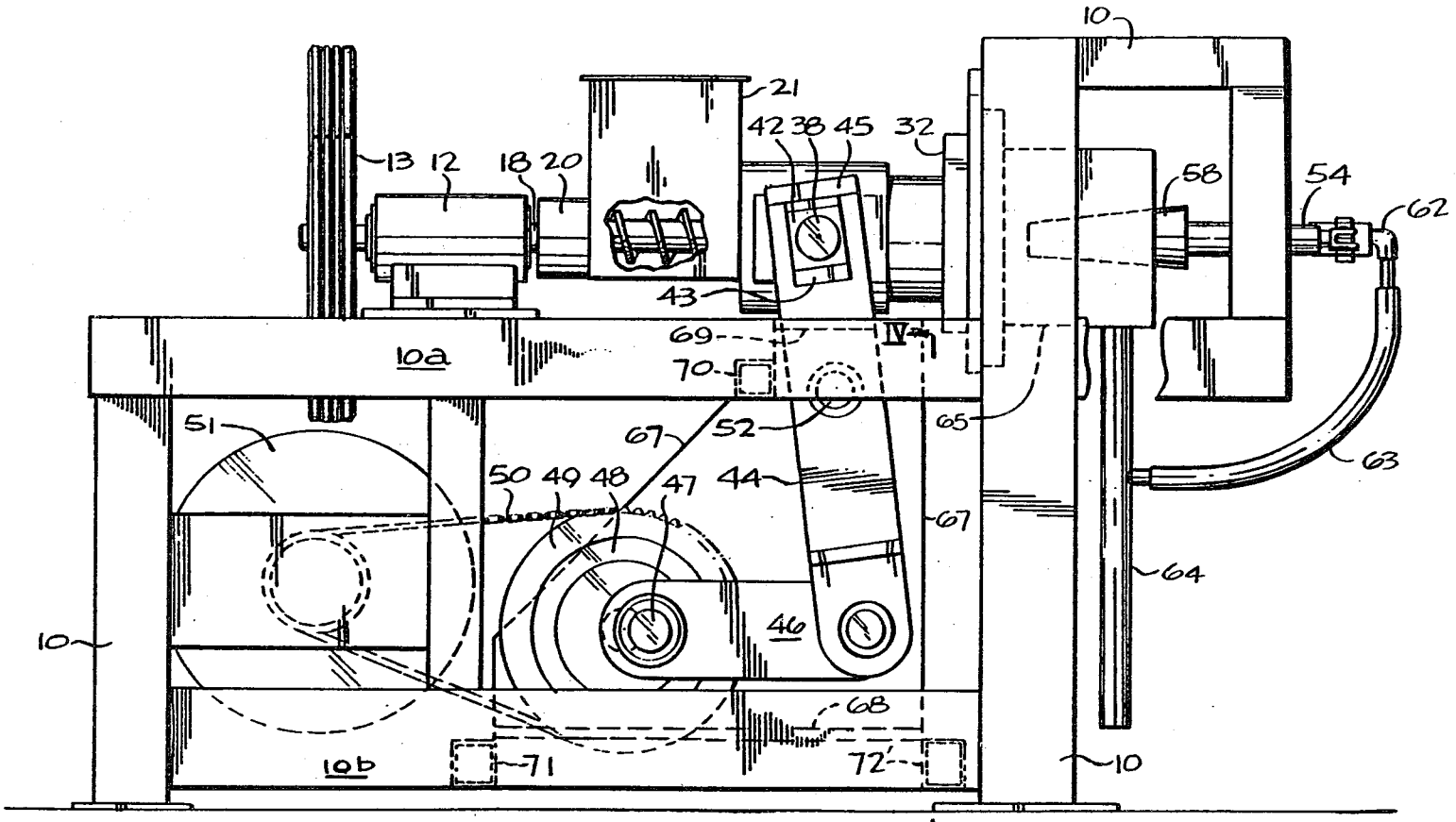
FIG. 1 is a simplified side view of the device, with certain parts of the machine omitted for the sake of clarity.

Reference numeral 10 designates a frame of the machine, including upper and lower side members 10*a*, 10*b* respectively. The frame 10 supports, on a base plate 11, a bearing housing 12 of a shaft 18, whose one end is provided with a V-belt drive pully 13 driven by a set of V-belts 14 engaged with a motor pulley 15 of a drive motor 16, mounted on base plate 17 which is fixedly secured to the frame 10.

The other end of the shaft 18 carries an auger 19. The shaft 18 passes through a seal housing 20. A portion of the auger 19 passes through the bottom section of an inlet box 21 to which a static hopper (not shown) or the like feed means may be connected on top for feeding the material to be processed into the machine. The bottom portion of the inlet box 21 comprises two supplementary augers 22 and 23, preferably coupled by a drive chain 24 and driven by suitable drive motor, schematically shown at 25. The free end of auger 19 passes through an opening 26 in the front wall of the inlet box 21, into a sleeve 27. The inside diameter of the sleeve 27 is selected such as to allow the sliding of the sleeve 27 on an inner tube 27*a* whose diameter, in turn, allows free rotation of the auger 19 while retaining a relatively close spacing between the two. The forwardmost end of the auger 19 protrudes slightly beyond the forward or free face 28 of the sleeve 27.

Figure 2:
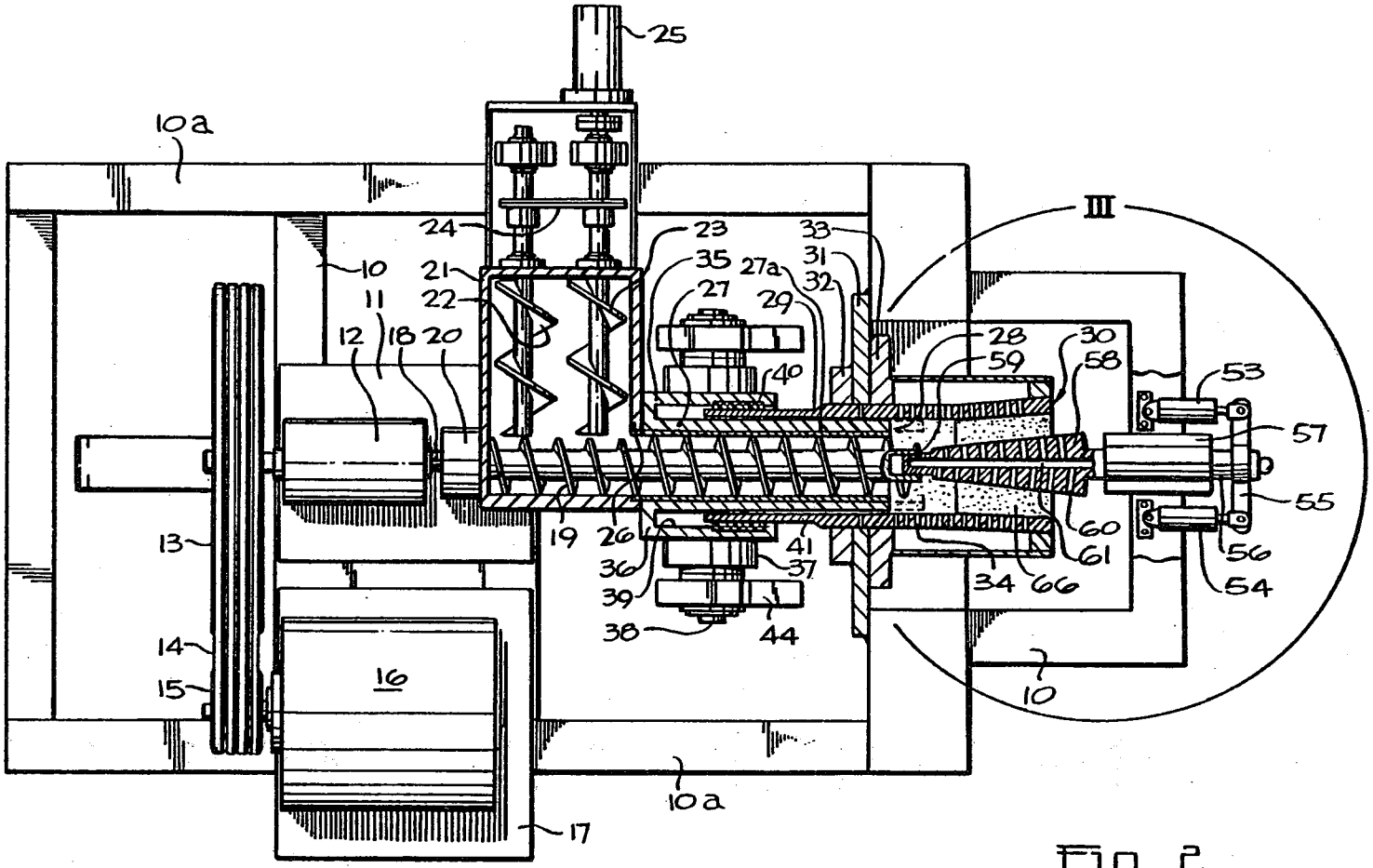
FIG. 2 is a plan view, partly in section, of the device shown in FIG. 1, with certain parts omitted for the sake of clarity.

As best shown in FIG. 2, the sleeve 27 is slidably mounted within a cylindric or tubular housing 29 whose end facing the inlet box 21 may be referred to as an "inlet end" or "inlet portion", while the end 30 may be referred to as a discharge end. The housing 29 is fixedly secured to the frame 10 by suitable securement means such as holding plate 31 welded to frame 10 and engaged by flanges 32, 33. The last described arrangement thus provides for a generally fixed securement of the housing 29 relatively to the frame 10.

Substantial portion of the wall of housing 29 to the right of FIG. 2 is provided with perforations 34. The perforated area preferably extends around the circumference of the tubular housing 29. The size and spacing of perforations 34 is determined by the type of material for which the machine is intended. As is well known in the art, the size will be such as to allow the average particle of the processed mass to traverse each of the dewatering openings to prevent the clogging of perforations 34 by the solid matter contained in the processed mass, while allowing the passage of water or other liquid that may be expressed from the mass.

Figure 3:
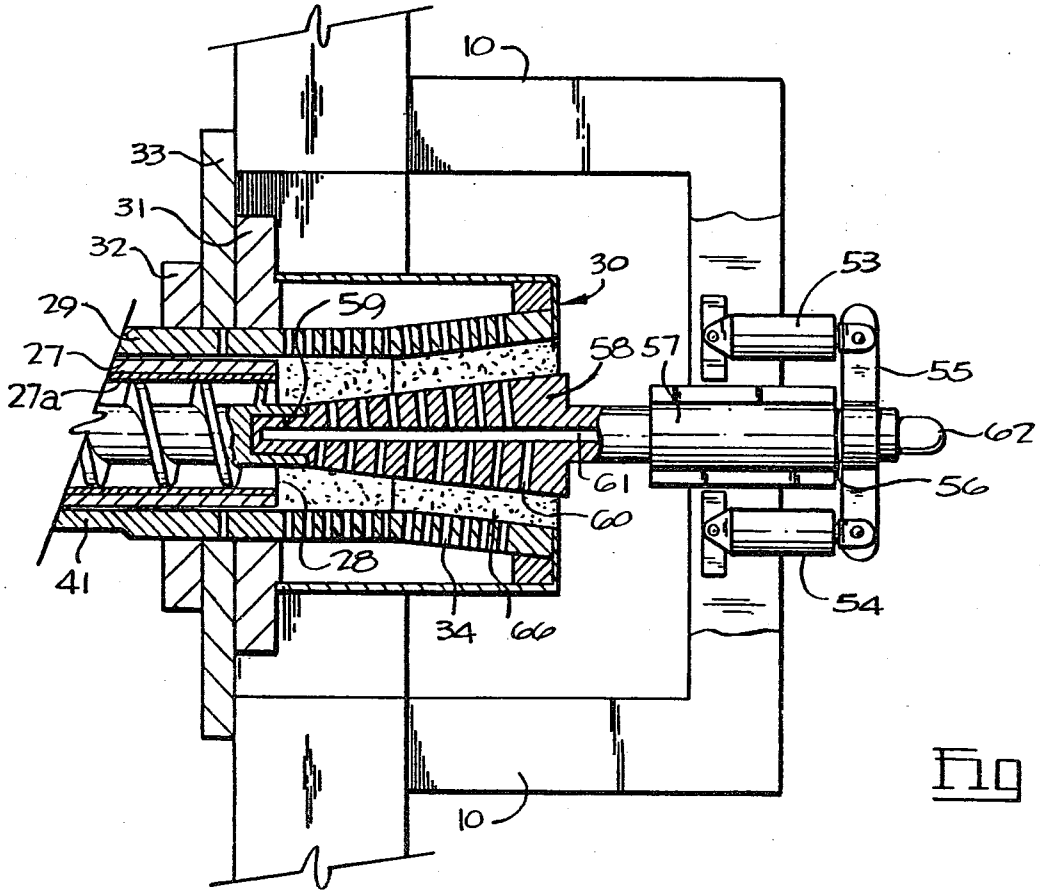
FIG. 3 is a detail III of FIG. 2 showing a choke adjustment different from that in FIG. 2.
Figure 4:
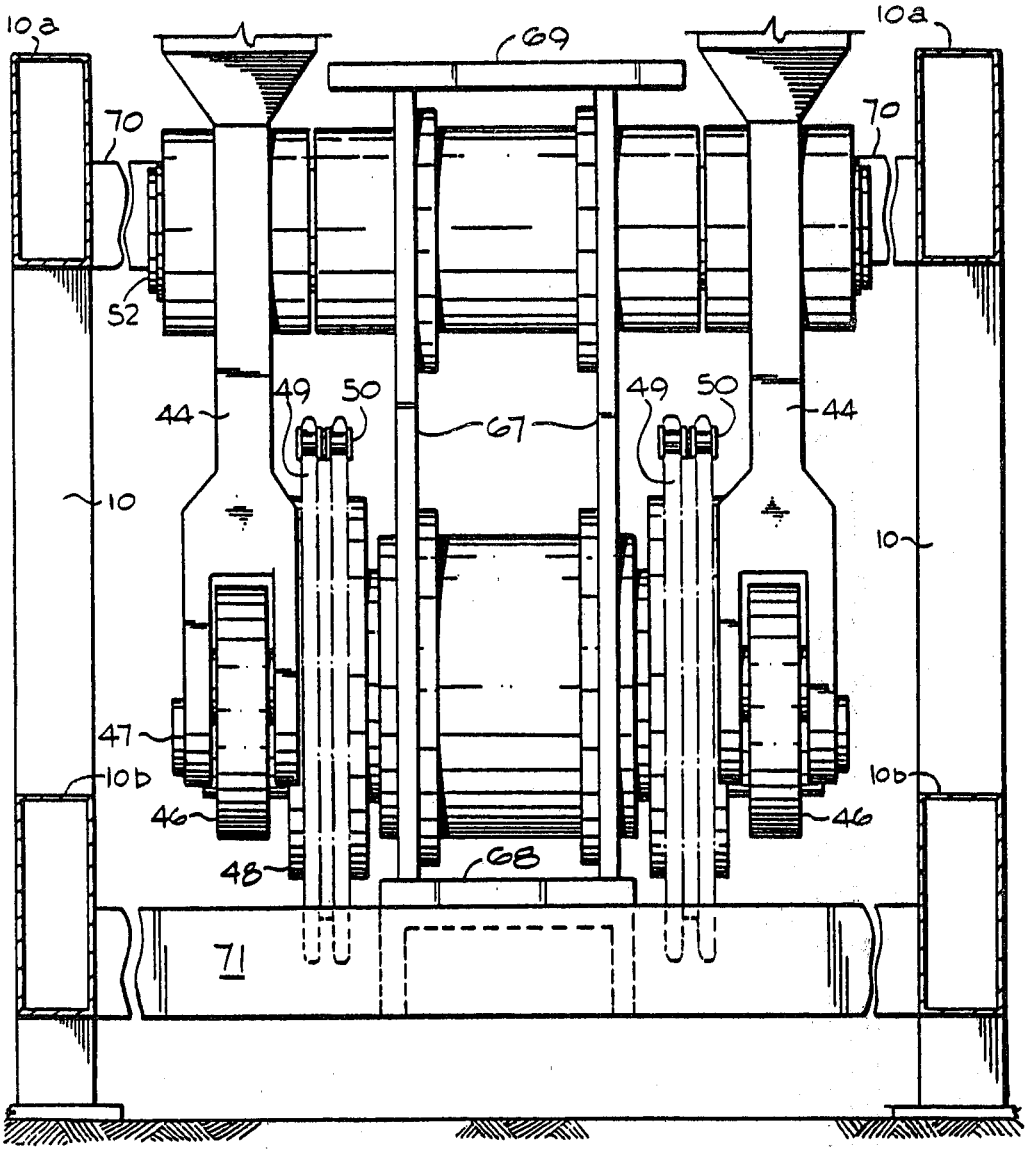
FIG. 4 is a partial sectional view IV—IV of FIG. 1.

As seen from FIGS. 2 and 3 the inside diameter of the housing 29 is slightly increased near the discharge end 30, to form a frustoconical outlet.

At the inlet end of the housing 29, the sleeve 27 is provided on each side with an outwardly and forwardly turned arm portion 35, 36, each of the portions 35, 36 being provided at the exterior with a boss 37 holding a journal pin 38 (only the boss and pin of arm portion 36 being designated with reference numerals).

The inside surface 39 of each arm portion 35, 36 is provided with a friction reducing lining 40 which facilitates the sliding engagement between the sleeve 27 and a slide portion 41 of the housing 29 near the inlet end thereof. It will thus be appreciated that the sleeve 27 can slide generally coaxially with the housing 29, the sleeve being guided both interiorly of the housing 29 and exteriorly thereof, by engagement of the lining 40 with the slide portion 41 of the housing 29.

Each pin 38 pivotally supports a rectangular block 42 slidably received within a guide slot 43 disposed at one end of a link rod 44, the slot 43 being enclosed by an end plate 45 at the upper end of the link rod 44 as viewed in FIG. 1. The opposite, lower end of the rod 44 is pivotally secured to one end of a connection link 46 whose opposite end is pivotally secured to an eccentric pin 47 of a drive disc 48 which, in turn, is keyed to a sprocket 49 driven by a drive motor (not shown) through a heavy duty drive chain 50. The drive unit of the chain 50 is provided with a flywheel 51. The link rod 44 is pivotal about an axis of a journal 52 pivotal in a housing fixedly secured to a pair of plates 67 integral with the frame at a base 68. The plates 67 are connected to each other by a top transverse plate 69 and by a transverse beam 70. The base 68 is fixedly secured to a pair of beams 71, 72 whose ends are welded to the lower side members 10*b* of the frame 10.

The mechanism comprised of the aforesaid block 42 through fly wheel 51 is an embodiment of a translating mechanism directed to translate the rotary motion of fly wheel 51 to a reciprocating motion of the sleeve 27 in a well known fashion.

It is indicated in FIG. 2, that the reciprocating motion of the sleeve 27 or of its face 28 has a predetermined path which is designed such that at least 50% of the entire length of the stroke of the face 28 towards the right-hand side of FIG. 2, i.e. towards the discharge end 30 reaches within the perforated area formed by perforations 34. This is indicated in broken line in FIG. 2, the full lines showing the sleeve in its extreme retracted position wherein the face 28 is located outside the perforated area 34 at the end thereof remote from the discharge end 30.

The described drive train for effecting the reciprocation of the sleeve 27 is designed such as to effect at least three cycles per second.

Mounted on the right-hand end portion of frame 10 (FIGS. 1 and 2) is a pair of hydraulic cylinders 53, 54 which are pivotally secured to free ends of a cross bar 55 whose centre is fixedly secured to a rod 56 generally co-axial with the axis of the housing 29. The rod 56 is adapted for sliding movement within a guide 57 secured to the frame 10. At the end remote from the cross bar 55, the rod 56 forms a conical choke body 58 convergent in the direction from the discharge end 30 to the inlet portion of the housing 29, preferably at an angle generally corresponding to the conical broadening of the interior of the housing at the discharge end 30. The apex portion of the conical body 58 merges with a generally cylindric tip 59 pivotally received within a cylindric cavity provided at the free end of the auger 19. The choke 58 is preferably perforated by a plurality of drain passages such as passage 60. The core of the choke body 58 is hollow and comprises an axial passage 61 communicating with a discharge elbow 62 (FIG. 1) connected with a drain hose 63 for removal of the liquid expressed from the processed matter, through a main drain passage 64 whose uppermost end as viewed in FIG. 3 is connected to a trough 65 for removal of water or liquid expressed through the perforations 34 of the housing 29.

It will be appreciated from the above that selective actuation of hydraulic cylinders 53 or 54 will result in actual displacement of the plug 58 relative to the housing 29, whereby the cross-sectional area of the annular space 66 between the interior of the housing 29 and the choke body 58 can be selectively adjusted. The area is shown at its maximum in FIG. 2, and at its minimum in FIG. 3.

In operation, the material to be processed, for instance wood chips having a relatively high content of water, is fed through a hopper into the inlet box 21. The supplementary augers 22, 23 urge the material that has reached the bottom of the box 21 toward the auger 19 which, in turn, advances the material, while simultaneously preliminarily compressing same, through the interior of the sleeve 27. Eventually, the material reaches, in a slightly compacted state, the area of the face 28 of the reciprocating sleeve 27. At thus point, the further compacting of the material is effected by the annular face 28 with the result that the mass is subjected to reciprocating pulsating effect whereby the mass advancing through the area of perforations 34 is subjected to repeated compression and release which results in an extremely effective dewatering of the mass through the perforations 34. The performance of the machine is particularly efficient if the frequency of reciprocations of the sleeve 27 is in excess of three cycles per second. It was found out that the upper range of the frequency of reciprocations of the sleeve 27 may be considerably higher and is practically limited only by structural limitations of the machine itself. In order to achieve maximum efficiency of the device, it is important that the stroke path of the reciprocating sleeve 27 be selected such that at least 50% of the entire length of the path travelled by the face 28 be disposed within the area of perforations 34. In the embodiment shown in FIG. 1, the travel is approximately 75% within the said region. In a fully retracted state, shown in full line of FIG. 2, the face 28 should be located out of the perforated region. If it stayed within the region, the sleeve body itself would block some of the perforations 34, thus reducing the efficiency of the machine. On the other hand, the efficiency of the machine would be impaired to an even more substantial degree if the face 28 went too far to the left of FIG. 2. The total length of the stroke of the sleeve 27 depends on the application intended for the machine. For instance, if the application is for a fibrous pulp, then the stroke may be relatively long and the frequency within say, three to five cycles per second. If, on the other hand, a fine material such as sawdust is to be dewatered, it is preferred to shorten the length of the stroke of the sleeve while increasing the frequency several fold.

The general purpose of the plug-shaped choke body 58 is known from the art. By reducing the cross-sectional area of the passage of the processed material through the perforated portion, the pressure at which the material is dewatered can be controlled. The area will normally be reduced to a minimum at the beginning of the operation, by displacing the choke body 58 to the extreme left of FIG. 2, to arrive at the position of FIG. 3. After the device has been started the choke may be gradually shifted to the right of FIG. 3 to a position between that of FIG. 3 and FIG. 2, as desired by operational conditions.

The use of the conical body 58 as a further dewatering means, by way of providing drainage passages 60 further enhances the liquid removal efficiency of the present invention.

The device according to the invention has been tested and found surprisingly effective in comparison with performance figures known from operation of other known types of the continuous presses known fron prior art. It is believed that the superior performance is particularly due to the fact that the face 28 of the sleeve tends to force the material not only in axial direction but also slightly radially inwardly. This, in turn, is believed to allow operation at relatively high pressures typical for the reciprocating sleeve operation, without imparting the passage of drained water through the compacted mass.

Those skilled in the art will readily conceive further embodiments of the device of the present invention differing to a greater or lesser degree from the preferred embodiment shown in the drawings. For instance, it will be appreciated that the way of effecting the reciprocating motion can be done by a great number of different ways utilizing known mechanisms of different kind, e.g. a hydraulic drive. The perforated area of passages 34 may be extended virtually up to the discharge end 30 or a solid portion of the housing 29 may be interposed between the downstream end of the perforated area 34 and the discharge end 30. Similarly, the choke body 58 may be replaced by different kinds of chokes known from prior art even though it is believed that the type of choke body 58 as shown in FIG. 2 is the best solution.

The aforesaid examples of modifications are but a short list of further modifications conceivable in hind sight of the teachings of the present invention. Many such modifications, even though departing from the embodiment disclosed in the present specification, do not depart from the scope of the invention as recited in the accompanying claims.

The embodiments of the invention in which an exclusive property or privilege is claimed are defined as follows:

1. A press for expressing liquid out of a mass comprised of a particulate soild material portion and a liquid material portion, said press being of the type having feeding means for feeding the mass through an inlet portion of the press; compression means for compressing said mass along a predetermined path within a housing means while advancing said mass to a discharge end thereof, and liquid passage means comprised in a portion of a wall of said housing means for removal of a part of the liquid portion to this reduce liquid content in said mass, wherein:

(a) said housing means is a hollow tubular housing whose one axial end is generally coincident with said inlet portion, the other axial end of said housing means being generally coincident with said discharge end;

(b) said compressor means is of the type including a conveyor screw combined with a reciprocating annular sleeve, said conveyor screw being co-axial with said housing means, a portion of said conveyor screw being rotabably disposed inside said annular sleeve whose outside diameter generally corresponds to the inside diameter of said housing means;

(c) said annular sleeve is slidable within said hollow housing means and is operatively associated with a first drive means for imparting to said sleeve a reciprocating motion relative to said housing means and to said conveyor screw, in a direction generally co-axial with said housing means; the frequency of the reciprocating motion being in excess of three cycles per second;

(d) said annular sleeve has a free end face portion of a generally flat, annular configuration, facing said discharge end;

(e) said liquid passage means is a plurality of closely spaced passage openings extending generally radially through a portion of the wall of said housing means to thus form a perforate section of said wall, said perforate section having an inside axial end relatively remote from said discharge end and an outside axial end relatively close to the discharge end;

(f) said annular sleeve and said liquid passage means being so arranged that said free end face portion thereof is disposed between said inside axial end and said outside axial end of the perforate section when the free end face portion of the sleeve is at the end of the stroke directed toward said discharge end, the axial distance travelled by said face portion within said perforate section being less than one-half of the total axial distance of said perforate section.

2. A press as claimed in claim 1, of the type wherein said perforate section is comprised of a cylindric portion and of a frustoconical portion, the latter being disposed at said discharge end, said press further comprising conical choke means within said frustoconical portion, the apex angle of the choke being generally identical with the angle of convergence of said frustoconical portion, the choke means being selectively displaceable in axial direction whereby the cross-sectional area of an annular passage between the choke means and the frustoconical portion is selectively adjustable, characterized in that the choke means includes pivot means at an apex portion of the choke means, said pivot means being adapted to rotatably engage the axial end portion of said conveyor screw which faces said discharge end of the press, whereby the choke means is devoid of any surface section facing directly axially against the flow of material through said perforate section.

3. A press as claimed in claim 2, wherein said pivot means is one part of a journal-and-bearing means, the other, second part of said journal-and-bearing means forming a part of a core section of said conveyor screw at the axial end thereof facing the discharge end of the press, said journal-and-bearing means being so arranged and disposed that the two parts thereof are maintained in operative engagement regardless of any instant axial position to the choke means within its selective adjustment relative to the frusto-conical portion.

4. A press as claimed in claim 3, wherein said one part of the journal-and-bearing means is a cylindric journal protruding from the apex portion of the choke means coaxially with same, said second part of said journal-and-bearing means being a cylindric opening coaxially with said journal and with the axis of rotation of the conveyor screw, said opening and said journal being so disposed relative to each other that they can be axially displaced over a predetermined axial length relative to each other while still engaged for relative rotation, said predetermined axial length being generally equal to the axial length of the selective displacement of the choke means.

* * * * *